United States Patent [19]

Titov et al.

[11] 4,044,801

[45] Aug. 30, 1977

[54] WEFT THREAD BEAT-UP MECHANISM FOR TRAVELLING WAVE SHEDDING LOOMS

[76] Inventors: Dmitry Vladimirovich Titov, 13 Parkovaya ulitsa, 27, korpus 2, kv. 49, Moscow; Jury Ivanovich Komarov, ulitsa Miklukho-Maklaya, 29, korpus 1, kv. 215, Moscow; Alexei Vasilievich Butuzov, Balaklavsky prospekt, 38, kv. 61, Moscow; Mazakhir Gamza Ogly Farzaliev, pereulok Mirza Fatalei, 13, Baku, all of U.S.S.R.

[21] Appl. No.: 685,634

[22] Filed: May 12, 1976

[30] Foreign Application Priority Data

May 15, 1975 U.S.S.R. ..... 2134357

[51] Int. Cl.[2] ..... D03D 47/26

[52] U.S. Cl. ..... 139/436

[58] Field of Search ..... 139/436, 188, 191, 196.3

[56] References Cited

U.S. PATENT DOCUMENTS

| | | | |
|---|---|---|---|
| 3,705,606 | 12/1972 | Stucki | 139/436 |
| 3,863,680 | 2/1975 | Titov et al. | 139/436 |

*Primary Examiner*—Henry S. Jaudon

*Attorney, Agent, or Firm*—Steinberg & Blake

[57] ABSTRACT

The invention relates to weft or filling thread beat-up mechanisms and can be effectively utilized in travelling wave shedding looms. The beat-up mechanism includes a series of discs mounted on a shaft, each disc having teeth of different heights radial, increasing in the weft thread beat-up direction, each tooth having the merging point of its rear or trailing edge and its outer edge situated radially higher than the merging point of its leading or front edge and this outer edge, whereby the breakage of both warp and weft threads is significantly reduced.

5 Claims, 3 Drawing Figures

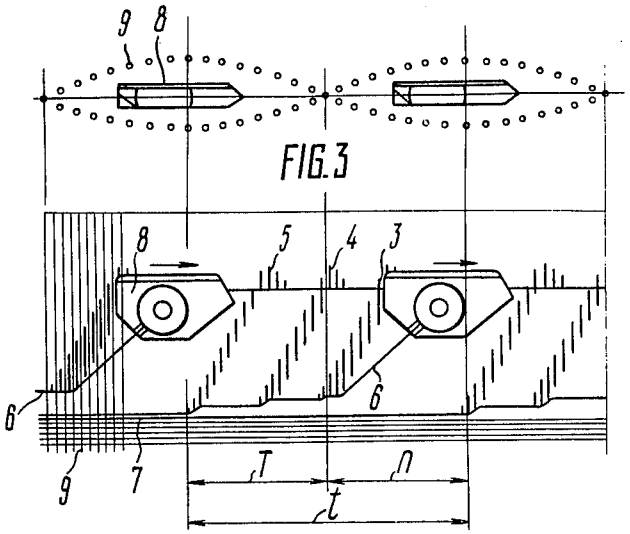
FIG. 3
FIG. 2
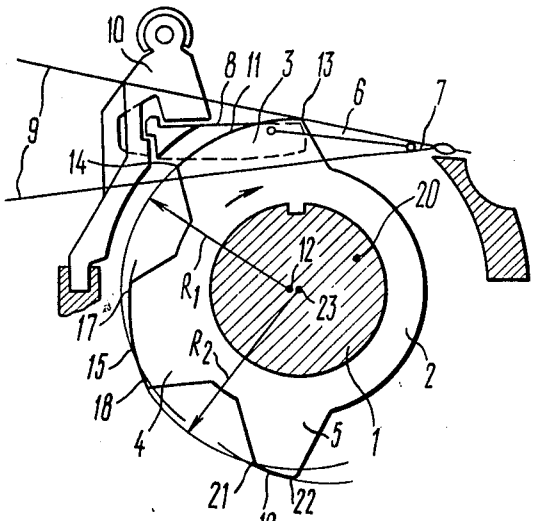
FIG. 1

WEFT THREAD BEAT-UP MECHANISM FOR TRAVELLING WAVE SHEDDING LOOMS

The invention relates to weaving looms, and, more particularly, it relates to mechanisms for beating up the weft or filling threads, incorporated in such looms.

At present, there is known a cloth-forming arrangement for weaving looms, including a weft thread beat-up mechanism comprising discs having about the circumference thereof teeth of different radial heights, adapted to beat up a weft thread to the fell of the cloth, the radial height of the teeth increasing in the weft thread beat-up direction. The discs are mounted on a shaft in a relatively angularly staggering fashion, so that the teeth thereof, having the same height, extend along a helix.

It is commonly known that while a cloth is being woven, its shrinkage, i.e. the reduction of the width of the cloth in comparison with the threading width, affects the extent to which the warp threads remain parallel, particularly pronounced in the areas adjoining the selvage, so that the threads become skewed with respect to the planes of the heat up discs. Since the angle defined by the front or leading edge and the outer edge of a tooth in the hitherto known discs is comparatively acute, the discs exert an intense action upon the threads, which is always damaging to the threads and quite often results in thread breakage. The more acute this angle, the more intense this action, and, hence the greater is the breakage rate.

Furthermore, the value of this angle influences the intensity of the action exerted by the discs upon the weft thread while it is being beaten up to the fell of the cloth, which action might likewise cause damage and even breakage of the thread.

It is an object of the present invention to create a weft thread beat-up mechanism, which should significantly reduce the mechanical action exerted by the teeth of the discs upon both the warp and weft threads.

It is an important object of the present invention to create a weft thread beat-up mechanism, which should reduce the rate of breakage of the warp and weft threads.

These and other objects are attained in a mechanism for beating up the weft threads in a travelling wave shedding loom, comprising a plurality of discs having about the circumference thereof teeth adapted to beat up a weft thread to the fell of the cloth being woven, the teeth having different radial heights increasing in the weft thread beat-up direction, said discs being mounted on a shaft in an angularly staggering fashion, so that the teeth thereof, having the same height, extend along a helix, in which mechanism, in accordance with the present invention, the merging point of the rear or trailing edge, in the weft thread beat-up direction, and the outer edge of a tooth of smaller radial height is situated radially higher than the merging point of the leading or front edge and the outer edge of the next tooth of greater radial height.

Owing to the merging point of the front edge of the tooth with the outer edge thereof having a radial height which is smaller than that of the merging point of the rear edge with the outer edge, the aforementioned angle increases, i.e. the outer edge of the tooth becomes more smoothed down. Consequently, a weft thread is beaten up by the central portion of the outer edge of the tooth, which means that the mechanical action of the tooth upon both the warp and weft threads becomes less intense.

The present invention will be better understood from the following description of an embodiment thereof, with reference being had to the accompanying set of drawings, wherein:

FIG. 1 is a side elevation of the hereindisclosed weft thread beat-up mechanism;

FIG. 2 is a schematic plan view illustrating the weft thread beat-up operation;

FIG. 3 is a schematic front view illustrating the shed formed by warp threads.

Referring now in particular to the appended drawings, the herein disclosed mechanism includes a driven shaft 1 (FIG. 1) supporting thereon a plurality of discs 2, each disc 2 having about the circumference thereof three teeth 3, 4 and 5. The teeth are of different radial heights, increasing in the direction of beating up a weft or filling thread 6 to the fell of the cloth 7, i.e. the tooth 3 is the shortest one, the tooth 4 is the medium-height one and the tooth 5 is the tallest one. The successive discs 2 are arranged on the shaft 1 in an angularly staggering fashion, so that the respective teeth thereof, having the same height, extend along a helix and propel a weft thread carrier 8. The spaces intermediate of the teeth of adjacent pairs of the discs accommodate therein the respective warp threads 9 which are guided with respect to the discs by separator plates 10, these plates also serving as guideways for the motion of a weft thread carrier 8.

The shape of the outer edge 11 of the shortest tooth 3 is defined by a radius $R_1$ having for its centre a point 12, the tooth also having the merging point 13 of the front or leading edge thereof and the outer edge 11, as well as merging point 14 of the rear or trailing edge of the tooth and the outer edge 11 thereof.

The shape of the outer edge 15 of the medium-height tooth 4 is defined by a radius $R_2$ extended from a centre 23, the tooth having the merging point 17 of the front edge and the outer edge 15 thereof and the merging point 18 of the rear edge and the outer edge 15 thereof.

The shape of the outer edge 19 of the tallest tooth 5 is defined by a radius extended from a centre 20, the tooth having the merging point 21 of the front edge and the outer edge 19 thereof and the merging point 22 of the rear edge and this outer edge 19.

Thus, on each disc 2 the merging point of the rear edge and the outer convex edge of a tooth of a smaller height has a greater radial height than the merging point of the front edge and the outer convex edge of the a tooth of a greater height. Thus, the point 14 has a greater radial height than the point 17, and the point 18 has a greater radial height than the point 21. Therefore, each tooth has the merging point of its front edge and its outer edge of a smaller radial height than the merging point of its rear edge and its outer edge.

Therefore, a weft thread is beaten up practically by the central portion of the outer edge of a tooth, which means that the mechanical action exerted upon the thread is reduced.

FIGS. 2 and 3 of the appended drawings illustrate, respectively, the pattern of heating up a weft thread and the motion of the weft thread carriers in the sheds. It can be seen in FIG. 2 that the shortest teeth 3 of the discs 2 advance the weft thread 6 toward the fell of the cloth 7 being woven, predominantly over the portion corresponding to the shed-opening operation, this portion being designated in FIG. 2 with letter *n*. The medium-height teeth 4 of the discs perform the initial beat-up of the weft thread 6, while the tallest teeth 5 finally beat up the weft thread 6, the beating-up of the weft thread 6 being effected over the portion corresponding to the maximum spread of the new shed, this portion being designated in FIG. 2 with letter T. The entire operation of the action of the teeth of the discs upon a weft thread takes place over a portion designated in the same FIG. 2 with letter *t*, this portion corresponding to the pitch of the helixes defined by the teeth of the discs, the entire threading width of the loom accommodating several such portions.

The herein disclosed mechanism performs the weft thread beat-up operation, as follows.

The weft thread 6 issuing from the weft thread carried 8 finds itself in the path of the shortest tooth 3 of which the outer edge forwards the weft thread toward the fell of the cloth 7. In accordance with the herein disclosed geometry of the tooth, the weft thread is acted upon predominantly by the outer edge 11 of this tooth, i.e. the point 13 exerts the minimum action and the point 14 the maximum action. Therefore, the destructing action of the tooth 3 upon the weft thread 6 is reduced to a minimum.

As the medium-height tooth 4, which is radially taller than the tooth 3, engages the weft thread 6, it begins to beat up the latter toward the fell of the cloth 7 approximately by the central portion of its outer edge 15, which is due to the fact that the merging point 17 of the front or leading edge of this tooth 4 and the outer edge 15 thereof is closer to the centre of the disc than the merging point 18 of its rear or trailing edge and its outer edge 15, and likewise closer to the centre of the disc than the merging point 14 of the rear edge of the tooth 3 and the outer edge 11 of the latter.

The weft thread 6 is finally beaten up by the tallest tooth 5, this last-mentioned tooth acting upon the thread 6 in a way similar to the action exerted thereupon by the tooth 4, i.e. the thread 6 is acted upon to a lesser degree by the merging point 21 of the front edge of the tooth 5 and its outer edge 19, and to a greater degree by the central portion of the outer edge 19 and by the merging point of the rear edge of this tooth 5 and its outer edge 19.

Thus, the herein disclosed mechanism enables to bring down the breakage rate of both the weft and warp threads, which has been attained by minimizing the action on the thread by the merging points of the front edges of the teeth and their outer edges. As a result, less time is spent on tying up the broken ends of the threads, whereby the downtime of the loom is reduced, and its productivity is stepped up.

It is thus apparent that each of the plurality of coaxial discs 2 has at least a pair of teeth of which one is a leading tooth and the other is a trailing tooth in the direction of rotation of each disc. Each of these teeth have leading and trailing edges which project outwardly from the center of each disc and which terminate in outer ends which merge with the convex outer edge of each tooth at the ends of this convex outer edge, thus forming between the leading and trailing edges and the outer convex edge of each tooth leading and trailing merging points. The trailing tooth of each pair of teeth of each disc is of a greater radial height than the leading tooth in the sense that the trailing merging point of the trailing tooth is situated at a greater radial distance from the center of each disc than the trailing merging point of the leading tooth. However, this trailing merging point of the leading tooth is situated at a greater radial distance from the center of each disc than the leading merging point of the trailing tooth, with the result that at least the trailing tooth of each pair does not engage a weft thread, during beating up thereof, with its leading merging point and instead acts on the weft thread, during beating up thereof, primarily at a central portion of its outer convex edge. These results are brought about by providing for the outer convex edges of the teeth radii of curvature which have centers situated at different locations with respect to the center of each disc, and also by the fact that these radii of curvature are of different lengths.

What is claimed is:

1. In a mechanism for beating up a weft thread in a travelling wave loom, a rotary shaft and a plurality of discs distributed along and carried by said shaft for rotation therewith, each disc having, for beating up a weft thread, at least a pair of teeth one of which is a leading tooth and the other of which is a trailing tooth in the direction of rotation of each disc, each of said teeth having leading and trailing edges projecting outwardly from the center of each disc and respectively terminating in outer ends, and each tooth having an outer convex edge extending between said ends of said leading and trailing edges of each tooth and having opposed ends joining said ends of said leading and trailing edges of each tooth respectively at leading and trailing merging points of each tooth, the trailing merging point of said trailing tooth being situated at a greater radial distance from the center of each disc than the trailing merging point of said leading tooth while the latter trailing merging point of said leading tooth is situated at a greater radial distance from the center of each disc than the leading merging point of the trailing tooth, said trailing tooth having a central portion of its outer convex edge situated at the same radial distance from the center of each disc as the trailing merging point of said leading tooth, so that during beating up of a weft thread at least said trailing tooth does not engage the weft thread with its leading merging point and instead provides for beating up of the weft thread primarily by engaging the latter thread at the central portion of said outer edge of said trailing tooth with the beating up action by said trailing tooth continuing up to the trailing merging point thereof.

2. The combination of claim 1 and wherein said outer convex edges of said leading and trailing teeth of each disc respectively have radii of curvature the centers of which are situated at different locations with respect to the center of said disc.

3. The combination of claim 1 and wherein said outer convex edges of said leading and trailing teeth of each disc respectively have radii of curvature which are respectively of different lengths.

4. The combination of claim 3 and wherein said radii of curvature respectively have centers which are respectively situated at different locations with respect to the center of said disc.

5. The combination of claim 1 and wherein each disc has three teeth following one after the other in the direction of rotation of each disc to form a first tooth, a second tooth, and a third tooth in the direction of rotation of each disc, said first and second teeth of each disc having with respect to each other the relationship of said pair of teeth and said second and third teeth also having with respect to each other the relationship of said pair of teeth, said second tooth forming a trailing tooth of said pair of teeth with respect to said first tooth and a leading tooth of said pair of teeth with respect to said third tooth.

* * * * *